US009439247B2

(12) United States Patent
Ingersoll, III

(10) Patent No.: US 9,439,247 B2
(45) Date of Patent: Sep. 6, 2016

(54) ELECTRODE CONSUMPTION MONITORING SYSTEM

(71) Applicant: GrafTech International Holdings Inc., Parma, OH (US)

(72) Inventor: Wyllys King Ingersoll, III, Montreat, NC (US)

(73) Assignee: GrafTech International Holdings Inc., Brooklyn Heights, OH (US)

( * ) Notice: Subject to any disclaimer, the term of this patent is extended or adjusted under 35 U.S.C. 154(b) by 974 days.

(21) Appl. No.: 13/670,981

(22) Filed: Nov. 7, 2012

(65) Prior Publication Data

US 2013/0121365 A1 May 16, 2013

Related U.S. Application Data

(60) Provisional application No. 61/556,623, filed on Nov. 7, 2011.

(51) Int. Cl.

| | |
|---|---|
| ***H05B 7/156*** | (2006.01) |
| ***H05B 7/148*** | (2006.01) |
| ***H05B 7/144*** | (2006.01) |
| ***H05B 7/20*** | (2006.01) |
| ***F27B 3/28*** | (2006.01) |
| ***F27D 19/00*** | (2006.01) |
| ***F27D 21/00*** | (2006.01) |

(52) U.S. Cl.

CPC . *H05B 7/20* (2013.01); *F27B 3/28* (2013.01); *F27D 19/00* (2013.01); *F27D 21/00* (2013.01)

(58) Field of Classification Search

CPC ..... H05B 7/156; H05B 7/144; H05B 7/148; H05B 7/109; H05B 7/20; F27D 21/00; F27D 19/00; F27B 3/28

USPC ..... 373/60, 62, 65, 69, 70, 88, 90, 91, 92, 373/94, 98, 105, 106, 102, 104

See application file for complete search history.

(56) References Cited

U.S. PATENT DOCUMENTS

| | | | | |
|---|---|---|---|---|
| 4,287,381 | A | 9/1981 | Montgomery | |
| 5,099,438 | A * | 3/1992 | Gulden, Jr. | G05B 19/058 373/104 |
| 5,274,664 | A | 12/1993 | Nigris et al. | |
| 7,313,160 | B1 * | 12/2007 | Gerhan | F27B 3/28 373/102 |
| 2007/0133651 | A1 | 6/2007 | Gerhan et al. | |

OTHER PUBLICATIONS

Balan, et al., Modeling and Control of an Electric Air Furnace, Jul. 29, 2007.

International Search Report and Written Opinion of the International Search Authority for PCT/US2012/63846, dated Jan. 31, 2013.

* cited by examiner

*Primary Examiner* — Hung D Nguyen

(57) ABSTRACT

A method and system automatically determines when an electrode add event occurs in an electric arc furnace having a plurality of electrode columns, each carried by an electrode positioning system. Data is received correlating to the harmonic distortion of the electrical current output to the plurality of electrode columns. Data is also received correlating to control pressures in the electrode positioning systems. Steady state control pressure data is captured when the harmonic distortion data indicates a steady state condition. An electrode add event is thereafter determined when a pressure spike is identified in the steady state control pressure data.

17 Claims, 3 Drawing Sheets

ELECTRODE CONSUMPTION MONITORING SYSTEM

This application claims the benefit of U.S. Provisional Application 61/556,623 filed Nov. 7, 2011, entitled Electrode Consumption Monitoring System, which is hereby incorporated herein in its entirety by reference.

An electric arc furnace heats a charge of scrap material by means of an electric arc. The charged material is melted by direct exposure to the electric arc and subsequent passing of the electric current therethrough.

An electric arc furnace generally includes a large vessel, covered with a retractable roof. The roof includes holes that allow one (in a DC furnace) or more commonly three (in an AC furnace) graphite electrode columns to enter the furnace. A movable electrode support structure holds and moves the electrodes columns. Power for the electrode columns is provided by a transformer, typically located near the furnace. The electrode columns each include a plurality of individual electrodes that are secured together with threaded connections at each end. The electrodes are slowly consumed as part of the steal making process and thus, new electrodes must be added to each column periodically.

During the heating cycle, a power regulating system attempts to maintain approximately constant current and power input during the melting of the charge. This is made more difficult when scrap moves under the electrodes as it melts. Input is regulated, in part, by employing an electrode positioning system which automatically raises and lowers the electrode columns. Thus, during portions of a heat the electrode columns tend to continuously oscillate based on the constant corrections performed by the positioning system. Commonly, positioning systems employ hydraulic cylinders to provide the moving force.

Once relatively steady state conditions are reached in the furnace, (i.e. the scrap is substantially melted) another bucket of scrap may be charged into the furnace and melted down. After the first or optional second charge is completely melted, various other operations take place such as, refining, monitoring chemical compositions, and finally superheating the melt in preparation for tapping.

Knowledge of the rate of consumption of electrodes is very valuable to an electric arc furnace operator. This data may help an operator analyze optimal furnace conditions or determine and compare electrode performance. In order to determine consumption, however, a system must accurately and automatically determine when an electrode is added to a column.

SUMMARY OF THE INVENTION

According to one aspect, a method is disclosed for determining when an electrode add event occurs in an electric arc furnace. The furnace includes a plurality of electrode columns, each carried by an electrode positioning system. The method includes receiving data correlating to the harmonic distortion of the electrical current output to the plurality of electrode columns. Data is then received correlating to control pressures in the electrode positioning systems. Steady state control pressure data is identified when the harmonic distortion data indicates a steady state condition. An electrode add event is determined when a pressure spike is identified in the steady state control pressure data. The electrode add event may then be displayed.

According to another aspect, a system is disclosed for monitoring an electric arc furnace having a plurality of electrode columns, each electrode column having an electrical current output therethrough and being vertically movable by an electrode positioning system.

The system includes a computing device having therein program code usable by the computing device. The program code includes code configured to receive or request data correlating to the harmonic distortion of the electrical current output to the plurality of electrode columns. Code is configured to receive or request data correlating to control pressures in the electrode positioning systems. Code is configured to identify steady state control pressure data when the harmonic distortion data indicates a steady state condition. Code is configured to determine an electrode add event when a pressure spike is identified in the steady state control pressure data.

DETAILED DESCRIPTION OF THE EMBODIMENTS

Graphite electrodes are a necessary consumable in an electric arc furnace and are the only known material suitable to withstand the extremely harsh operating environment of the electric furnace steelmaking operation. Accordingly, steel manufacturers are highly cognizant of the cost and performance of the graphite electrodes being consumed in the furnace. Commonly, the rate of electrode consumption is expressed in terms of pounds of electrodes consumed per ton of steel produced (hereinafter "lb/ton"). Generally, steel electric arc furnace operators seek to minimize the lb/ton consumption of graphite electrodes to thereby minimize electrode costs and increase profits.

According to one embodiment, electrode consumption may be determined from the following data inputs: 1) tons of steel produced per heat (hereinafter "tons/heat"); 2) number of heats per electrode add (hereinafter "heats/add"); and 3) pounds of graphite per electrode. Advantageously, each data source is automatically determined (i.e. without regular input from a human operator). Accordingly, the number of tons/heat may be readily determined and acquired from the furnace control system, which closely monitors the tons/heat. Likewise, the pounds per electrode may advantageously be a constant input representing an average electrode weight for a given size. In this or other embodiments, a database or other electronically stored data matrix may be employed storing the average weights for various electrode sizes. Electrode consumption is typically calculated over a period of time. For example, in one embodiment the electrode consumption is calculated as the consumption over one week period. In other embodiments the consumption may be calculated over a two week period. In still other embodiments the electrode consumption is calculated over a one month period. In still further embodiments, the consumption is calculated for periods longer than about 3 days.

Determining the number of heats/add requires first knowing when an electrode is added to each electrode column. As discussed above, the determination that an electrode is added to one or more of the electrode columns is advantageously performed automatically.

Figure 1:
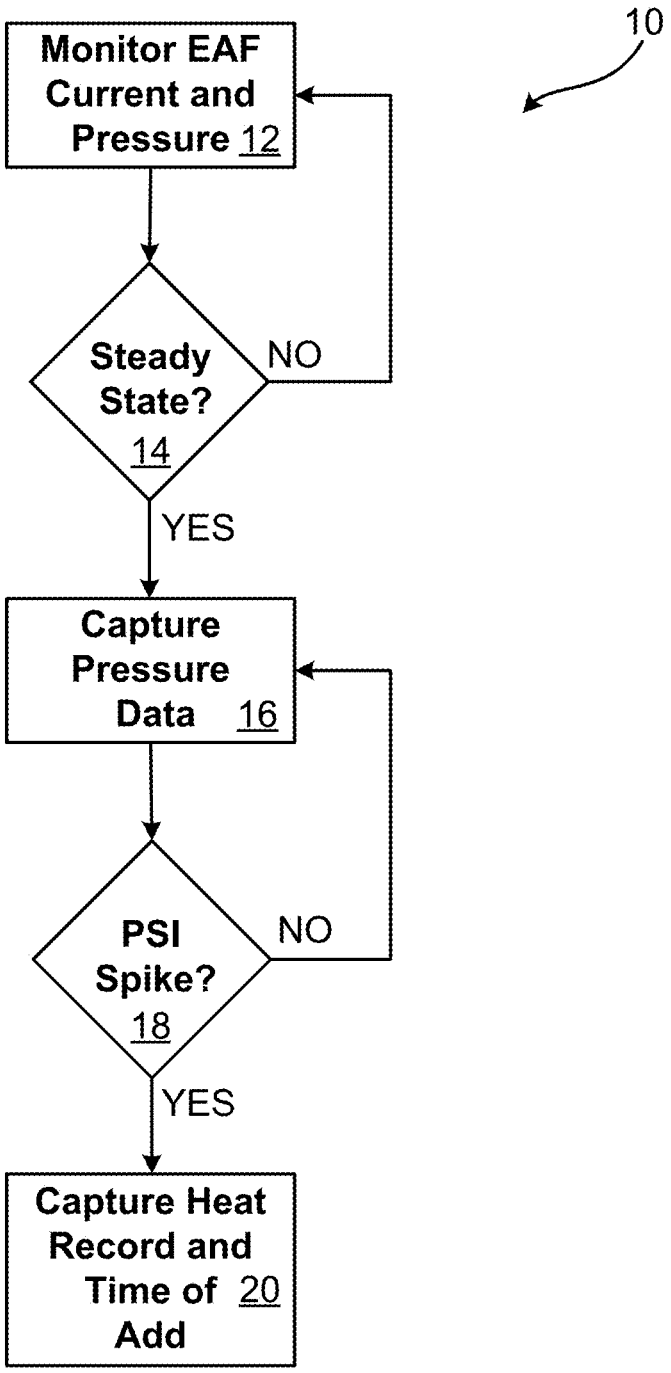
FIG. 1 is a flow chart showing exemplary steps for determining an electrode add event.

With reference now to FIG. 1, a method for automatically determining when an electrode is added to an electrode column is shown and indicated by the numeral 10. In a first step, two operating parameters of the electric arc furnace are monitored. In one embodiment, the current on the primary side of the arc furnace transformer is monitored via metering transformers. In another embodiment, the current on the secondary side of the arc furnace transformer is monitored via metering transformers.

The second data source is from the electrode positioning system. As discussed above, during a heat each electrode column is individually moved up and down by an electrode positioning system to regulate arc length as the charged scrap melts in the furnace. In one embodiment, the actuating force that moves the electrode columns is provided by a hydraulic system, wherein varied pressure functions to move the electrode columns upward and downward. In this embodiment, the actuating pressure at each electrode column is monitored via, for example, a pressure monitor.

At a second step 14, it is determined whether the furnace is in a steady state condition. By steady state, it is meant that the charge inside the oven is substantially melted and/or the surface of the charge is generally flat. In other words, the large pieces of scrap are no longer falling from the periphery into more central points in the furnace. This is commonly referred to as a flat bath condition.

In one embodiment the steady state condition is determined by monitoring the harmonic distortion of the electrode current waveform (from the metering transformers). In one embodiment, when the harmonic distortion is less than 10%, a steady state condition is determined. In other embodiments when the harmonic distortion is less than 5% a steady state condition is determined. In still further embodiments, when the harmonic distortion is less than 3% a steady state condition is determined. In one embodiment, the harmonic distortion being analyzed is for each electrode column or phase. In another embodiment, the average harmonic distortion of the current through all three electrodes (all three phases) is monitored.

At 14, if the furnace is not at a steady state condition, the system continues to monitor the current. However, if a steady state condition is determined, then pressure data is now captured at step 16. Steady state pressures are advantageous because at this point in the heat, relatively little electrode column movement is required (because of the flat bath condition). Thus, the pressure values are relatively stable and will correlate to a relative weight of each electrode column.

Figure 2:
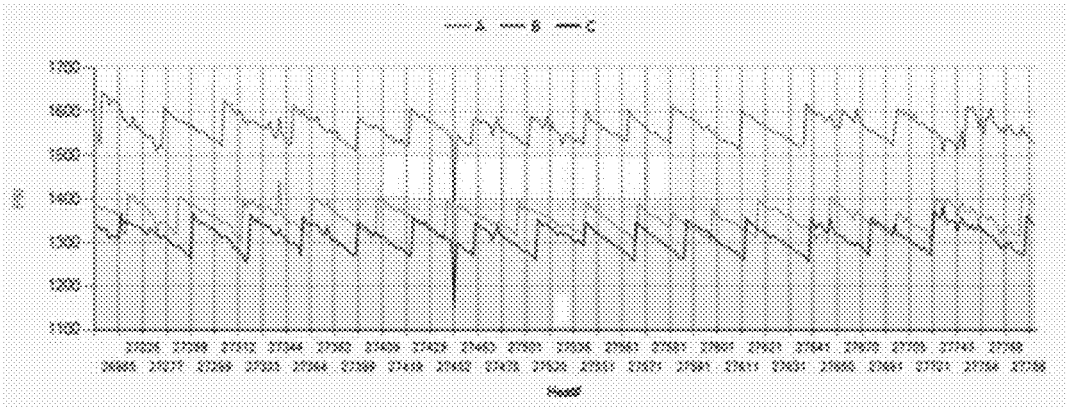
FIG. 2 is an exemplary chart showing steady state pressure readings for an EAF furnace.

With reference now to FIG. 2, a chart shows exemplary pressure data captured during steady state operation. As can be seen, the pressure for each electrode column A, B, and C steadily drops as the electrode column is consumed in the furnace. However, a spike can be seen in the pressure data corresponding to the addition of an electrode to the column. In this manner, at step 18 it is determined when an electrode add has occurred. In one embodiment, the electrode add is determined when at least a 3% pressure increase is measured. In another embodiment, an electrode add is determined when at least a 5% pressure increase is measured. In still other embodiments, an electrode add is determined when a minimum predetermined absolute pressure changed is measured. For example, in one embodiment if an increase of greater than about 100 psi is measured, it is determined than an electrode add has occurred. In another embodiment, if an increase of greater than about 50 psi is measured, it is determined that an electrode add has occurred.

At step 20 the electrode add event is captured, as well as the time of the add. As will be discussed in greater detail below, the add data may be correlated with other data from the furnace, such as the number and timing of each heat. In this manner, it can be determined how many heats are performed per electrode add over a given time period.

Once the heats per add is known, an electrode consumption calculation may be performed according to the following equation:

Electrode consumption (lb)/(ton)=(nominal electrode weight of one electrode)/((heats per electrode addition)*(average heat steel weight))

As discussed above, nominal electrode weight may be drawn from a database file that stores nominal weights for all nominal sizes. Likewise, the average heat steel weight for a given time period may be collected by the furnace controller. The calculated electrode consumption may be provided to furnace operators in any manner. For example, in one embodiment, the electrode consumption is calculated on servers at a remote location (using data from the furnace communicated via the internet). The furnace operator may then access the electrode consumption data (in chart or graph form for example) via a website.

Figure 3:
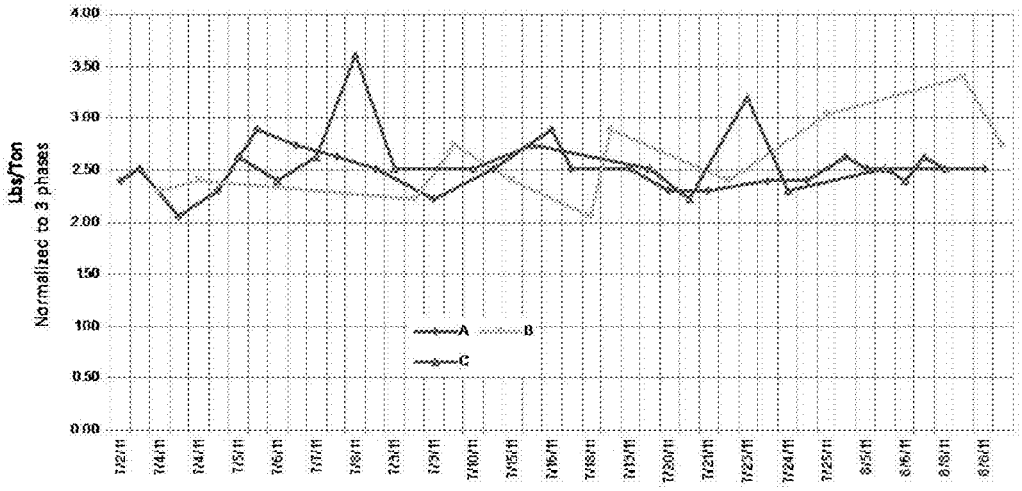
FIG. 3 is an exemplary chart showing electrode consumption rates for an EAF furnace.

With reference now to FIG. 3, the chart shows an exemplary electrode consumption display that may be provided to furnace operators. Such information may be used to compare consumption levels between different electrode columns within a furnace or to compare different electrode manufacturers/materials to optimize performance. In addition, by automatically determining the underlying frequency of electrode adds, a remote electrode supplier may adjust inventory or production based on the near real-time view of a furnace operator's electrode usage.

Figure 4:
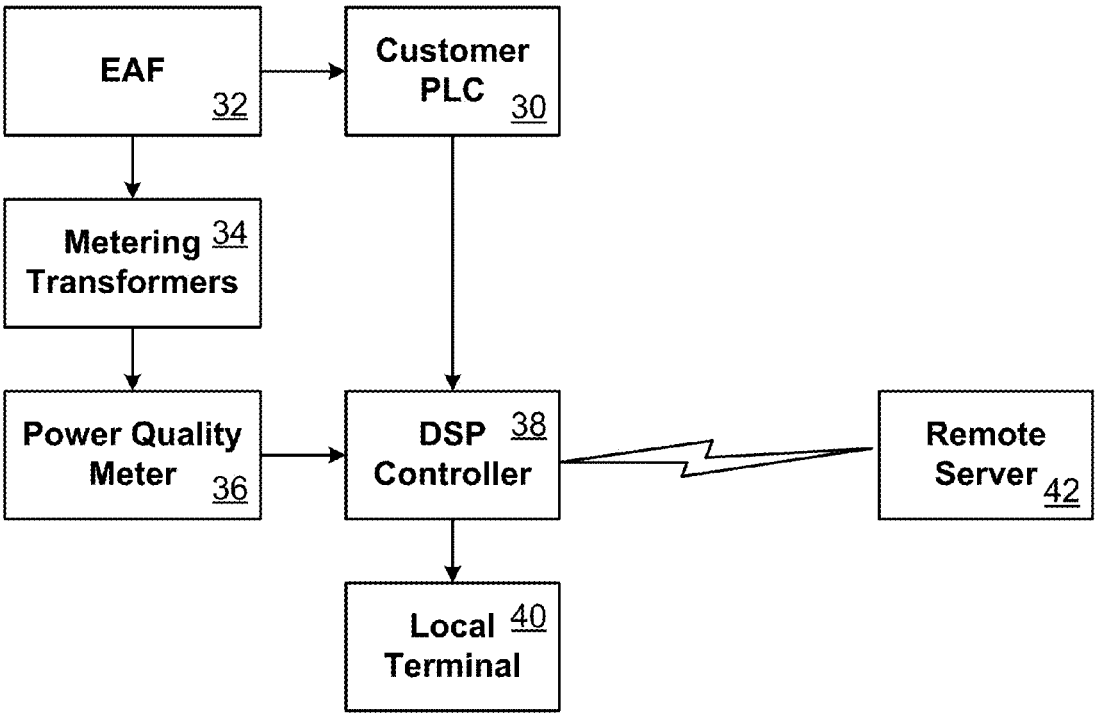
FIG. 4 is an exemplary furnace monitoring system adapted to determine electrode add events and/or electrode consumption.

With reference now to FIG. 4, an exemplary electrode consumption monitoring system is shown. A furnace PLC 30 sends and receives signals from various control mechanisms associated with the electric arc furnace 32. For example, furnace PLC 30 may receive and or calculate signals representing the production (tons) per heat, end of heat signals, and hydraulic pressures in the electrode positioning system. Likewise metering transformers 34 may be in circuit with the primary or secondary sides of the furnace transformer. A power quality meter 36 receives the output from the metering transformers 34. The power quality meter 36 may measure, among other things, the harmonic distortion in the electrode current waveforms. The harmonic distortion data signals may then be sent to a digital signal processor 38. In one embodiment, the power quality meter 36 performs the calculations to average the harmonic distortion from all three phases. In other embodiments, the digital signal processor 38 performs the calculations to average the harmonic distortion from all three phases.

Digital signal processor 38 receives signals from both the power quality meter 36 and the furnace PLC 30. The data may be output to a local terminal/server 40 or to a remote server 42. According to one embodiment the local and/or remote server includes an SQL database. The SQL database may query the data from the digital signal processor 38 to determine an electrode add and/or the electrode consumption. In other words, according to one embodiment, the digital signal processor 38 collects data from the furnace PLC 30 and power quality meter 36 and then transmits the data via a query to the SQL database residing on the server 40 and/or 42. According to this embodiment, SQL queries/ routines may then be employed to determine when an electrode addition occurs. Thereafter, consumption, add and other performance data may be displayed in the form of on-line accessible web reports that furnace operators may access via a password protected web page.

In the above description, numerous specific details are set forth in order to provide a thorough description of the present invention. It will be apparent, however, to one skilled in the art, that the present invention may be practiced without these specific details. In other instances, well-known features have not been described in detail so as not to obscure the invention.

As can be appreciated by one of ordinary skill in the art, the present invention may take the form of a computer program product on a tangible computer-usable or computer-readable medium having computer-usable program code embodied in the medium. The tangible computer-usable or computer-readable medium may be any tangible medium such as by way of example, but without limitation, a flash drive, a hard disk, a random access memory (RAM), a read-only memory (ROM), an erasable programmable read-only memory (EPROM or Flash memory), an optical storage device, or a magnetic storage device.

Computer program code for carrying out one or more of the operations of the present invention may be written in an object oriented programming language such as Java, C++ or the like, or may also be written in conventional procedural programming languages, such as the "C" programming language. The program code may execute entirely on the on a local server/computer, partly on the local server/computer, as a stand-alone software package, partly on the local server/computer and partly on a remote computer/server or entirely on the remote computer/server. In the latter scenario, the remote computer/server may be connected to the local data sources and/or local computer/server through a local area network (LAN), a wide area network (WAN), or through the internet.

The various embodiments described herein can be practiced in any combination thereof. The above description is intended to enable the person skilled in the art to practice the invention. It is not intended to detail all of the possible variations and modifications that will become apparent to the skilled worker upon reading the description. It is intended, however, that all such modifications and variations be included within the scope of the invention that is defined by the following claims. The claims are intended to cover the indicated elements and steps in any arrangement or sequence that is effective to meet the objectives intended for the invention, unless the context specifically indicates the contrary.

What is claimed:

1. A method for determining when an electrode add event occurs in an electric arc furnace having a plurality of electrode columns, each carried by an electrode positioning system, the method comprising:

receiving data correlating to a harmonic distortion of an electrical current output to the plurality of electrode columns;

receiving data correlating to control pressures in the electrode positioning system;

identifying steady state control pressure data when said harmonic distortion data indicates a steady state condition; and determining the electrode add event when a pressure spike is identified in said steady state control pressure data.

2. The method according to claim 1 wherein said pressure spike is identified when a pressure increase of at least 5% occurs.

3. The method according to claim 1 wherein said pressure spike is identified when a pressure increase of at least 100 psi occurs.

4. The method according to claim 1 wherein the steady state condition is determined when the harmonic distortion of said electrical current flowing through each said electrode column is less than about 10%.

5. The method according to claim 1 wherein the steady state condition is determined when the harmonic distortion of said electrical current flowing through each said electrode column is less than about 5%.

6. The method according to claim 1 wherein the steady state condition is determined when the average harmonic distortion of said electrical current flowing through all said electrode columns is less than about 10%.

7. The method according to claim 1 wherein the steady state condition is determined when the average harmonic distortion of said electrical current flowing through all said electrode columns is less than about 5%.

8. The method according to claim 1 further comprising displaying the steady state control pressure data in graphical form via a website.

9. A system for monitoring an electric arc furnace having a plurality of electrode columns, each electrode column having an electrical current output therethrough and being vertically movable by an electrode positioning system, the system comprising: a computing device having therein program code embodied in a non-transitory computer readable medium usable by said computing device, the program code comprising: code configured to receive or request data correlating to a harmonic distortion of the electrical current output to the plurality of electrode columns; code configured to receive or request data correlating to control pressures in the electrode positioning system; code configured to identify steady state control pressure data when said harmonic distortion data indicates a steady state condition; and code configured to determine an electrode add event when a pressure spike is identified in said steady state control pressure data.

10. The system according to claim 9 wherein said pressure spike is identified when a pressure increase of at least 5% occurs.

11. The system according to claim 9 wherein said pressure spike is identified when a pressure increase of at least 50 psi occurs.

12. The system according to claim 9 wherein the steady state condition is determined when the harmonic distortion of said electrical current flowing through each said electrode column is less than about 10%.

13. The system according to claim 9 wherein the steady state condition is determined when the harmonic distortion of said electrical current flowing through each said electrode column is less than about 5%.

14. The system according to claim 9 wherein the steady state condition is determined when the average harmonic distortion of said electrical current flowing through all said electrode columns is less than about 10%.

15. The system according to claim 9 wherein the steady state condition is determined when the average harmonic distortion of said electrical current flowing through all said electrode columns is less than about 5%.

16. The system according to claim 9 further comprising code configured to display the steady state control pressure data in graphical form.

17. The system according to claim 9 further comprising code configured to display electrode add events in graphical form.

* * * * *